US008701909B2

(12) United States Patent
Endert

(10) Patent No.: US 8,701,909 B2
(45) Date of Patent: Apr. 22, 2014

(54) CLOSURE DEVICE FOR A CONTAINER

(75) Inventor: Guido Endert, Leichlingen (DE)

(73) Assignees: Horst Wergen (DE); Alexander Christ (DE)

( * ) Notice: Subject to any disclaimer, the term of this patent is extended or adjusted under 35 U.S.C. 154(b) by 246 days.

(21) Appl. No.: 12/994,455

(22) PCT Filed: May 27, 2009

(86) PCT No.: PCT/EP2009/056490
§ 371 (c)(1),
(2), (4) Date: Feb. 17, 2011

(87) PCT Pub. No.: WO2009/150058
PCT Pub. Date: Dec. 17, 2009

(65) Prior Publication Data

US 2011/0139744 A1 Jun. 16, 2011

(30) Foreign Application Priority Data

May 27, 2008 (DE) ..... 10 2008 025 429
May 27, 2008 (DE) ..... 10 2008 025 430

(51) Int. Cl.
*B65D 55/02* (2006.01)
*B65D 51/16* (2006.01)
*B65D 43/04* (2006.01)
*B65D 45/16* (2006.01)

(52) U.S. Cl.
USPC ..... 215/260; 215/216; 215/225; 220/231; 220/281; 220/324

(58) Field of Classification Search
USPC ..... 215/200, 216, 225, 228, 260, 307, 310, 215/902; 53/476; 220/281, 324, 326, 231, 220/367.1
See application file for complete search history.

(56) References Cited

U.S. PATENT DOCUMENTS 3,863,798 A 2/1975 Kurihara
3,949,897 A 4/1976 Shaw
(Continued)

FOREIGN PATENT DOCUMENTS

AT 169590 11/1951
DE 7731724 1/1978
DE 29800040 U1 10/1998
(Continued)

OTHER PUBLICATIONS

International Search Report PCT/EP2009/056490; Dated Sep. 29, 2009.
Chinese Office Action 200980119232.6; Filing Date May 27, 2009; Mail date Dec. 2, 2011.
(Continued)

*Primary Examiner* — Anthony Stashick
*Assistant Examiner* — Madison L Poos
(74) *Attorney, Agent, or Firm* — Cantor Colburn LLP

(57) ABSTRACT

The invention relates to a closure device (2) for closing and/or opening an opening (1.1) of a container (1), wherein the opening (1.1) of the container (1) is closed in a first position (I) of the closure device (2) and the opening (1.1) of the container (1) is open in a second position (II) of the closure device (2), and wherein the opening (1.1) of the container (1) has an opening periphery (1.2) which comprises an inner wall (1.3) and outer wall (1.4), and wherein the closure device (2) has a sealing element (4) by means of which the opening (1.1) of the container (1) can be closed with sealing action in the first position (I), and wherein the closure device (2), in the first position (I), is fastened on the container (1) by a closure element (3) and, when the container (1) is opened, can be transferred from the first position (I) into the second position (II) by means of at least one actuating element (3.2) wherein the container opening (1.1) can be opened only by pressure (Pt) being applied to the actuating element (3.2).

13 Claims, 5 Drawing Sheets

(56) References Cited

U.S. PATENT DOCUMENTS

| | | | | |
|---|---|---|---|---|
| 5,449,077 | A * | 9/1995 | Seidler | 215/216 |
| 5,697,510 | A | 12/1997 | Wang et al. | |
| 5,979,680 | A * | 11/1999 | Farside | 215/216 |
| 6,439,409 | B1 | 8/2002 | Dressel et al. | |
| 6,612,450 | B1 | 9/2003 | Buono | |
| 6,619,493 | B2 * | 9/2003 | Yang | 215/228 |
| 6,789,690 | B2 * | 9/2004 | Nieh et al. | 220/231 |
| 7,048,136 | B2 * | 5/2006 | Havens et al. | 220/212 |
| 2001/0035388 | A1 * | 11/2001 | Miceli et al. | 215/228 |
| 2004/0195241 | A1 | 10/2004 | Stull | |

FOREIGN PATENT DOCUMENTS

| | | |
|---|---|---|
| FR | 1569844 A1 | 6/1969 |
| FR | 2205449 | 11/1973 |
| FR | 2559455 A1 | 8/1985 |
| GB | 1433208 | 4/1976 |

OTHER PUBLICATIONS

Chinese Office Action 200980119232.6; Filing Date May 27, 2009; Mail date Sep. 12, 2012.

OA MX/a/2010/012880 dated Jun. 12, 2013, with English translation.

* cited by examiner

CLOSURE DEVICE FOR A CONTAINER

TECHNICAL FIELD

The following invention is directed towards a closure device for closing and/or opening an opening of a container. Such closure devices serve to close a container which has an opening edge comprising an inner and an outer wall. The container can, for example, comprise a can, in particular, a drinks can, bottle, storage container or similar. Furthermore, the container itself can comprise plastic, metal, porcelain, glass or various other materials. The closure device has a sealing element whereby the opening of the container can be closed in a sealing manner. In the first position, the closure device itself is fastened on the container in particular positively by means of a closure element, wherein the closure element has an actuating element in order to open the closure element.

BACKGROUND

Known containers are usually closed in a sealing manner by closure devices, by pressing the seal in the closure device between the closure device itself and the container, in particular an opening edge. By this means, a seal is effected particularly in containers which build up an internal pressure. In this context, it is known that the contact pressure on the sealing element must be greater than the internal pressure forming or present in the container so that the closure device correspondingly seals the container. Such closure devices are used, for example, in drinks bottles as a lid. In this case, the lid is pressed with the drinks bottle by means of a thread which is provided whilst applying a high force so that the sealing effect of the closure device is produced by a corresponding deformation of the seal.

It is further known, for example, to close a test tube with a rubber stopper, the rubber stopper being configured in a frustro-conical manner and being pressed with a high contact pressure, which is difficult to apply, into the opening edge of the test tube in order to close this. In this case, a deformation of the rubber stopper must also be effected by a corresponding contact pressure. Furthermore, for example, crown cork closures for bottles are known which also press the sealing element between the crown cork closure, which serves as a closure device, and the bottle edge. Such crown cork closures have the disadvantage that they are not re-usable and they can only be opened with a crown cork lifter. Furthermore, they can only be attached with the aid of mechanical devices in order to close the bottle. In addition, further numerous variants of closure devices for containers are known from the general prior art, which all exert a corresponding contact pressure from above or inside onto the sealing element in order to deform this or press on the opening edge.

Furthermore, the present invention is also directed towards a container having a closure device according to the invention. Likewise, the present invention is also directed towards a method for closing and opening a container having a corresponding opening by a closure device.

Known, for example, from the document DE 103 12 237 A1 is a closure for a can in which the can closure is attached mechanically in an opening of the can lid. The closure itself has a multipart structure and has a hinged lid which is integrated on the closure device. The entire can can then be closed with the aid of the closure lid. This closure device has the disadvantage that on the one hand, it must be previously connected to the can by production technology and on the other hand, it does not close the can in a gas-tight or pressure-tight manner. It is not possible to reuse the closure.

BRIEF SUMMARY

The invention provides a reusable closure device which enables rapid and uncomplicated handling, in particular without additional aids, when opening and closing the container. At the same time, the closure device should be easy to use with little force for weak and clumsy persons.

In the device according to the invention, it is provided that the container opening or the container can only be opened by a simple pressure (Pt) on the actuating element or elements. By this means the fastening of the closure element to the container is completely released. At the same time or subsequently, the closure device can be removed from the container opening by simply lifting. Hence, the opening of the container can be executed by means of the at least one actuating element by a one-handed actuation, although for increased safety the container can be supported by the other hand of the user although this is not absolutely essential. Subsequently, mention is always only made of the actuating element even if this can comprise a plurality of actuating elements. The closing of the container is also executed in a simple manner by simply pressing the closure device gently from above onto the container opening until the closure element is securely fastened on the container. The (closure) pressure (Pk) to be applied here is independent of the internal pressure (Pi) of the closed container which possibly builds up. In addition, it may be necessary to apply a gentle pressure onto the actuating element in order to transfer the closure device into the first position (I), which means the closure position. A time-consuming and force-consuming firm turning or pressing, which can usually only be executed with two hands, can thus be avoided. Consequently, a one-handed opening of the closure device is possible, wherein in particular a one-handed closing can be achieved.

A sealing of the container by the closure device is independent of a contact pressure (Pk) which is applied from the closure device onto the container via the sealing element, in particular the opening edge. Consequently, the sealing element is not pressed between the closure device and the container, in particular the opening edge, in order to close the container from above and/or from inside in a sealing manner. Therefore no contact pressure needs to be applied by the closure device during closing in order to close the container in a pressure-tight manner. A simple placement and arresting of the closure device, for example, by means of a form fit with the container, is sufficient for this. Consequently, a contact pressure (Pk) from the closure device onto the container produces no additional deformation of the sealing element in the sealing area. Hence the closure device according to the invention is particularly easy to actuate for weak and clumsy or movement-impaired persons. Unlike in the conventional closure devices from the prior art, no contact pressure (Pk) needs to be exerted on the closure device so that the container is nevertheless reliably sealed. On the contrary, the pressure on the sealing element produced by the own weight of sealing element and possibly closure device is sufficient to close the container in a sealing manner. Consequently, the closure device according to the invention is configured to be self-sealing since the existing or still-forming internal pressure (Pi) is used to close the container. In so doing, the internal pressure (Pi) presses the sealing element onto the opening edge (1.2), in particular onto an inner wall (1.3) of the opening edge (1.2).

It is further provided, for example, that the sealing element itself has a sealing lip which projects into the opening of the container and comes to abut sealingly against the inner wall of the opening edge due to an elastic deformation. In so doing, the sealing lip abuts loosely on the inner wall of the opening edge without being pressed into the inner wall by another element such as, for example, the closure device. For this purpose, the sealing lip has, for example, a wedge-shaped or trapezoidal cross-section which abuts flexibly or highly flexibly against the inner wall of the opening edge. For example, PTFE, silicone, rubber or PU foam etc. can be used as material for the sealing element, in particular the sealing lip, at the same time the selected material should be flexible to highly flexible. This material is readily deformable so that the sealing lip can abut unconstrainedly and without any expenditure of force (therefore force-free) against the inner wall of the opening edge and adapt over the full circumference. In so doing, a closed sealing line should initially form between the sealing lip and the opening edge or the inner wall. Due to the abutment points of the sealing lip on the opening edge or on the inner wall, the container is completely sealed. This material, for example, has a hardness of 10 to 90 shore A, in particular of 40 to 80 shore A (according to standards DIN 53505 and DIN 7868). A material having a hardness of 70 shore A is preferred since the best sealing results so far have been established in this case. At the same time, the material is indeed flexible but also dimensionally stable in order to obtain the desired sealing effect. For this purpose, the sealing element can have a dimensionally stable core made of harder material which is surrounded by a softer or more flexible material. It is also feasible to obtain the dimensional stability by constructive measures such as, for example, reinforcing ribs, edges or the like. It has also proved to be advantageous if the abutting surface of the sealing lip is configured to be smooth in the area of the sealing line.

The self-acting sealing of the container by the closure device is made by the shape and size and the material properties of the sealing element, in particular by the sealing lip. At the same time, it is provided that an outer contour of the sealing element, in particular of the sealing lip is configured to be complementary to an inner contour of the opening edge of the container, wherein the sealing element, in particular the sealing lip abuts against the inner wall of the opening edge over the full circumference. If, for example, the inner contour of the opening of the container is configured to be circular, the outer contour of the sealing element is therefore also substantially circular. In the case of a triangular opening contour, the outer contour of the sealing element is also configured to be substantially triangular. Likewise, the size of the sealing element substantially corresponds to the size of the container opening to be closed. In this case, it is recommended that an external circumference of the sealing element is somewhat larger, i.e. a few tenths of a millimeter to millimeters, than the maximum size of the internal circumference of the opening edge. Due to this configuration of the sealing element, in particular the sealing lip, the desired elastic deformation is achieved, which is necessary for the initial sealing of the container. For this elastic deformation, no contact pressure is required between the closure device and the container. On the contrary, the pure weight of the sealing element or the closure device is sufficient to effect the desired elastic deformation of the sealing element. At the same time, the dimensional stability of the sealing element itself is helpful for bringing the sealing lip to abut securely against the opening edge or the inner wall. Otherwise, if the elastic deformations are too great, the sealing element could tend to form wrinkles or kinks which are undesirable since this would prevent a sealing.

As has already been mentioned, the contact pressure (Pk) which is applied from the closure device onto the container, in particular the opening edge, is substantially unimportant for the operating mode of the sealing element so that it is without effect in the sense of this application. If a contact pressure (Pk) between the container and the closure device is too high, the sealing element can even be deformed in such a manner, e.g. by wrinkle formation that a sealing no longer takes place. Consequently, the operating mode of the closure device according to the invention does not depend on the contact pressure (Pk) between the container and the closure device. Also, after merely placing the closure device on the opening of the container (without further fastening or arresting of the closure device with the container due to the aforementioned form fit), the sealing element need not be additionally elastically deformed in order to correctly seal the container. On the contrary, due to the closure device according to the invention, the container can be sealed self-actingly in a pressure-tight and/or fluid-tight manner by means of the sealing element without producing a previous contact pressure (Pk) between the container and the closure device from above and/or from inside. It is thus possible, for example, to even seal conventional drinks cans or drinks bottles which build up a high internal pressure (Pi) due to their carbonic acid content in a gas and fluid-tight manner. Also no constructive modification of the containers known from the prior art is required to use the closure device according to the invention.

It can further be provided that the sealing lip of the sealing element is initially only pressed onto the inner wall by its elastic deformation, wherein in particular a developing or existing internal pressure of the container additionally presses the sealing lip onto the inner wall if the internal pressure (Pi) is greater than an external pressure (Pa) surrounding the container from outside. Thus, the existing and possibly increasing internal pressure (Pi) also automatically increases the sealing effect of the sealing element and therefore of the closure device. Unlike in usual seals, it is therefore not necessary to press the closure device more firmly onto the container so that the closure device still reliably closes the container with increasing internal pressure (Pi). In the closure device according to the invention, only a destruction or tearing of the sealing element, in particular of the sealing lip itself, leads to a leakage of the closed container.

It is also feasible that the sealing element simultaneously acts as a valve element so that the internal pressure (Pi) of the container is automatically adapted to the external pressure (Pa) of the container if the external pressure (Pa) is greater than the internal pressure (Pi). It is therefore possible that a fluid, usually in the form of air, can penetrate into the container from outside but not conversely. In this case, the higher external pressure (Pa) presses the sealing lip away from the internal wall of the opening edge when the internal pressure (Pi) of the container is lower. However, if the internal pressure (Pi) of the container is higher than the external pressure (Pa), the internal pressure (Pi) presses the sealing lip onto the inner wall of the opening edge with the result that the pressure is maintained in the container. For this it is necessary that the sealing lip is correspondingly flexibly configured in order to thus adapt to the pressure differences due to its elastic deformation. This adaptation of the sealing element also functions in the case of a hydrostatic internal pressure on the seal, e.g. due to sloshing liquids in the container.

Likewise, in one embodiment of the invention it can be provided that the sealing element extensively seals the entire opening of the container with a flat part, wherein the sealing element has an angled edge zone from the flat part which is substantially formed by the sealing lip. Thus, the entire opening of the container can be sealed merely by the sealing element. In another embodiment of the invention it is feasible that the closure device has a retaining plate to which the sealing element is fastened, wherein in particular the sealing element is only configured as a sealing lip and the sealing lip is arranged in a pressure-tight and/or fluid-tight manner on the retaining plate. Consequently, the extensive part of the sealing element can be dispensed with since this is replaced by the additional retaining plate. It is also feasible that the additional retaining plate completely fixes the sealing element on its rear side. For this purpose, the sealing element can be welded, adhesively bonded or injection moulded to the retaining plate. It is also feasible that the sealing element is connected to the retaining plate or the closure device itself by means of a form fit and/or frictional connection. In this case, however, the sealing element should seal the entire opening of the container with the flat part in order not to produce any additional tightness problems at the intermediate points between sealing element and retaining plate.

The closure device itself is fastened on the container by a closure element, wherein the closure element in particular cooperates positively with the container by means of at least one holding means by way of a closure, in particular a bayonet closure, a click-clack closure, a clasp closure, a clip closure, a loop closure and/or a sliding closure. The closure element thus ensures that the sealing element withstands the internal pressure of the container since otherwise the sealing element with the closure device would be pushed out from the opening of the container. The previously mentioned closure between the closure element and the container can, for example, only exist on a form fit. In addition, a frictional connection can optionally ensure the positionally fixed fixing of the closure device above the opening of the container. However, this frictional connection does not result in any elastic deformation of the sealing element at the regions to be sealed, in particular the sealing lip.

In order to improve the operation of the closure device, this can be fitted with a safety element and/or a valve, wherein the safety element avoids or makes difficult any unintentional opening of the container and the valve is configured as a pressure relief valve or a drain valve. This safety element is intended to prevent the closure device from being unintentionally removed from the container. In this case, the safety element should be matched to the closure provided. The previously mentioned valve is intended to prevent an explosion-like, in particular uncontrolled, opening of the closure device from a container at high internal pressure by allowing the excess pressure to escape beforehand. For this purpose the valve has an actuating means or nipple. In order to enable particularly easy operation of the closure device, it is feasible that operation of the closure element leads directly to or has already previously led to operation of the valve. Consequently, the valve is necessarily actuated first by means of the actuating means, whereby the possibly existing internal pressure (Pi) can escape in order to open the closure device by means of the actuating element. To this end, the actuating element can be connected mechanically to the actuating means. The two previously mentioned elements or means can also be configured in one piece. The valve mentioned can be provided with a desired acoustic function which can be produced by a blow-in or cutting edge. In this way, the area of application of the closure device, particularly for visually impaired persons and/or for advertising purposes or the like, can be significantly increased.

It is also feasible to provide the closure device with a tamper-evident closure whereby it can be shown that the container, hitherto unused, was closed by the closure device according to the invention. Such a tamper-evident closure can be a paper and/or film seal which, for example, can easily be removed by means of a pull-off tab. The tamper-evident closure can also have predefined predetermined breaking points which break when the closure device is actuated for the first time to open the container.

In order to enable the easiest possible operation of the closure device, it can optionally be provided that the actuating element and/or the actuating means are configured in a button-like manner, wherein in particular an actuation or movement is made easier by, in particular partially slit-shaped incisions. These incisions, which can be provided as continuous grooves in the closure device, adjoin the actuating element and/or the actuating means. At the same time, these slit-shaped incisions do not completely enclose the actuating element and/or actuating means so that these are connected in one part or in one piece to the remaining closure device. A slit-shaped incision can usually be configured to be U-shaped or cup-shaped, wherein the U and the cup can be inverted. In practice it has been shown that it is appropriate to arrange the actuating means above the actuating element so that the actuating means can act directly on the sealing element which is usually disposed in the upper region of the closure device. The actuating element, on the other hand, should preferably be arranged in the lower region of the closure device so that it can cooperate with a corresponding arranged holding means.

In order to be able to fasten the closure device securely on the container so that this can withstand the internal pressure (Pi), the closure element can have at least one holding means which cooperates mechanically with a counter-holding means on the container. The holding means and the counter-holding means hereby effect a form fit, wherein a pressure (Pt) on the actuating element can release the form fit. The counter-holding means on the container can be formed by an, in particular, annular or cam-shaped projection or an in particular peripheral recess, whereas the holding means on the closure element can be formed by an, in particular, strip-shaped section, barb-shaped projection or part-like section. A pressure on the actuating element in this case effects a deformation and/or a movement in the form of a shift or pivoting of the holding means. The pressure (Pt) on the actuating element thus has the effect that the holding means no longer cooperates positively with the counter-holding means on the container.

In the already-mentioned click-clack closure (colloquial designation for this type of closure), the closure element of the closure device has a centre piece having holding means disposed in approximately the central actuation zone and on the centre piece. In relation to a first position (I) in which the closure element forms a form fit with the container, in particular with a projection or a groove on the container outer edge, the centre piece has an inner surface pointing towards the container and an outer surface pointing away from the container. The holding means which marginally surround the centre piece in particular in the manner of a crenellation, are bent at an angle $\alpha$ towards the inner surface. In this case, the angle $\alpha$ is preferably somewhat greater than 90°. Each holding means is also bent at its end, again towards the inner surface, ideally bent at right angles towards the longitudinal axis of the container or even directed slightly upwards in order to achieve a secure form fit between closure element and container.

The closure element is preferably made of hard metal, in particular of metal or plastic but is nevertheless sufficiently elastic that it can adopt two different positions (I, II) in the form of two secured positions. In the first position (I), the closure device closes the container with the closure element. The centre piece hereby covers the opening of the container. In this case, it is curved slightly away from the container in the direction of the longitudinal axis. When viewed from the inner surface of the centre piece, this corresponds to a concave curvature. Due to this curvature the holding means run approximately parallel to the side surface of the container which has the projection. In this case, the angled ends of the holding means form a form fit with the projection. Therefore, unlike other containers, the container also remains closed when an attempt is made to open the container by pulling apart closure element and container.

The container can be opened, on the other hand, if a pressure is applied only to the actuation element or the actuation zone in the direction of the longitudinal axis and in the direction of the container. The centre piece undergoes an elastic deformation from one secured position into the other and curves in the direction of the container. When viewed from the inner surface of the centre piece, this corresponds to a convex curvature. In the course of the elastic deformation, the holding means move away from the container and release the projection. By this means the closure device with the closure element can now be released from the container, easily and without any force, in particular without applying any tensile force.

If the container is to be closed again, the closure device with the closure element is placed with the inner side to which the holding means point, on the container. In this case, the holding means are still at a slight distance from the projection. By means of pressure on the holding means, in particular perpendicular to the longitudinal axis, the centre piece moves from a secured position, corresponding to convex curvature when viewed from inside, into the other secured position, corresponding to concave curvature when viewed from inside, and the closure element enters into its first position (I) again.

In the closure device according to the invention, it can be provided that the sealing element is disposed or fastened in the closure element by means of a form fit, a welded connection and/or a heat embossing. In a click-clack closure the available holding means can be used for the positive fastening. An edge of the sealing element protruding over the sealing lip can also serve as a stop buffer or means for the opening edge of the container. Expediently the sealing element does not project from the closure device so that an unintentional destruction of the sealing element in the event of the closure device not being used can be reliably avoided. Consequently, the closure device can be temporarily placed, no matter how, on a table or the like, without the seal being able to come in contact with the table.

The invention further provides a container which can be reliably closed with a closure device by a simple manipulation without any fluid being able to escape from the closed container. This container can, for example, comprise a conventional can, drinks can, storage can, bottle or the like which can be composed of most diverse materials.

The invention also provides a method for sealing a container with an opening by means of a closure device which is easy to handle and seals the opening of the container by the closure device. In this context, it is provided according to the invention that a sealing of the container by the closure device takes place independently of a contact pressure (Pk) which is applied from the closure device onto the container, in particular the opening edge. The method according to the invention can be executed with the closure device according to the invention. Features and details described in connection with the closure device according to the invention naturally also apply in connection with the method according to the invention and conversely. Features mentioned in the claims and in the description can each be essential to the invention by themselves or in combination.

BRIEF DESCRIPTION OF THE DRAWINGS

Preferred exemplary embodiments of the invention are given in the following description with reference to the appended drawings and the following description. The exemplary embodiments are examples and are not shown true to scale. In the figures.

DETAILED DESCRIPTION

In the following figures, the same technical features are provided with identical reference numbers, even when these are presented in a different embodiment or another exemplary embodiment of the invention.

Figure 1:
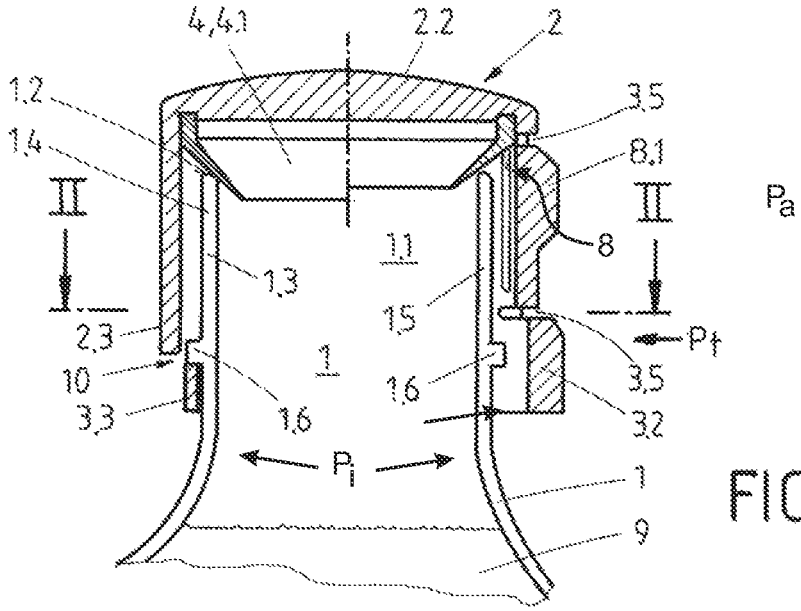
FIG. 1 shows an angled section I-I through a first exemplary embodiment of the closure device according to the invention from FIG. 3, which closes the opening of a container.
Figure 6:
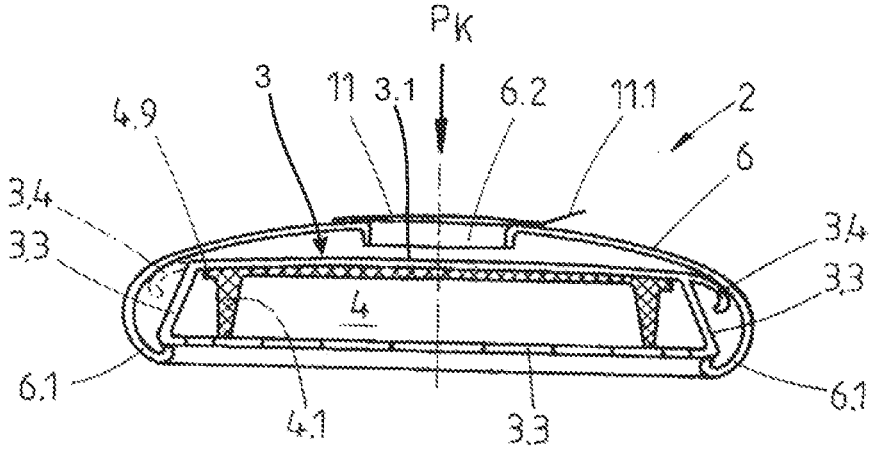
FIG. 6 shows a longitudinal section through a further closure device according to the invention which is fitted with a click-clack closure element.

FIG. 1 shows a first exemplary embodiment of the closure device 2 according to the invention, where this closure device 2 in a first position I closes an opening 1.1 of the container 1. In the present exemplary embodiment, the closure device 2 shown comprises a closure element 3 with a holding means 3.3 which is configured to be strip-shaped or broad-band-shaped. The holding means 3.3 can be clearly identified in FIG. 4. The closure device 2 itself is fastened on the container 1 by a closure element 3, wherein the closure element 3 in particular cooperates positively with the container 1 by means of at least one holding means 3.3 by way of a closure 10, in particular a bayonet closure, a click-clack closure (s. FIG. 6), a clasp closure, a clip closure, a loop closure and/or a sliding closure (s. FIG. 7). FIG. 1 shows a section (see left side) through the corresponding holding means 3.3. It can be seen that the strip-shaped holding means 3.3 comes to abut positively behind a projection 1.6 of the container 1. The projection 1.6 is configured to be substantially annular and rises radially from the remaining diameter of an outer wall 1.4 of the container 1. Since the closure device 2 is connected through the closure element 3 positively to the container 1, a developing internal pressure Pi cannot raise or push away the closure device 2 from the container opening 1.1. On the contrary the closure device 2 with its provided sealing element 4 closes the container 1 in a pressure- and fluid-tight manner. For this purpose, the (inverted) frustro-conical sealing element 4 rests with its radially circumferential sealing lip 4.1 on the opening edge 1.2 of the container 1. It is also feasible that the sealing element 4 projects into the opening edge 1.2 and there comes into contact with an inner wall 1.3 of the container 1. The sealing element 4 is configured to be flexible and easily deformable and is not pressed onto or into the opening edge 1.2. On the contrary, it rests in a force-free manner on the opening edge 1.2 and forms a closed sealing line with the opening edge 1.2. Since the sealing element 4 is configured to be hollow, the internal pressure Pi can act from inside on the sealing element 4, in particular the sealing lip 4.1, which in the present case is configured to be wedge-shaped, that is tapering downwards to a point.

In order that the closure device 2 in the container 1 can close in a pressure and fluid-tight manner, as already mentioned, the sealing element 4 is adapted to the inner contour 1.5 of the opening edge 1.2. For this purpose, the sealing element 4 has a complementary inner contour 4.5 to the inner contour 1.5 of the container. The sealing element can itself be disposed on the closure device 2 in a non-positive, seamless and/or positive manner. In any case, the combination of closure device 2 and sealing element 4 must enable the sealing of the closure device 2. For this purpose, the sealing element 4 can be firmly welded or adhesively bonded to the closure device 2, in particular in the upper part 2.2. A hot embossing of the sealing element 4 on the closure device 2 is also feasible.

In order that the closure device 2 can be operated easily and with one hand, an actuating element 3.2 can be provided on the closure element 3, which acts mechanically on the holding means 3.3. In the present case (FIGS. 1-4), the actuating element 3.2 is configured to be button-like. A pressure Pt leads to a deformation of the closure element 3, whereby the strip-shaped holding means 3.3 jump behind the projection 1.6 since they expand radially. Consequently, after applying a pressure to the actuating element 3.2, the closure device 2 can be removed or lifted from the container 1. The closure element 3 has a substantially symmetrical structure and has two actuating elements 3.2, which are arranged at about 180° on the external circumference, in particular in the region of the lower part 2.3 of the closure device 2. Likewise, two holding means 3.3 are provided, which are radially expanded by the two actuating elements 3.2 during an actuation. The two holding means 3.3 form an oval or elliptical profile to a longitudinal axis 2.1 in cross-section. As a result of the pressure Pt on the two actuating elements 3.2, the elliptical profile of the strip-shaped holding means 3.3 is expanded radially so that it is then more or less circular and releases the radial projection 1.6 of the container 1.

If the container 1 has a higher internal pressure Pi that the external pressure Pa of the container, a specific release of the internal pressure Pi is recommended. For this purpose a valve 8 is provided in the closure device 2 which can be operated by means of an actuating means 8.1. In the exemplary embodiment from FIG. 4, the actuating means 8.1 is provided twice on the closure device 2, each being arranged above the actuating elements 3.2 and each assigned to one another at 180° on the circumference. By means of a pressure applied to the actuating means 8.1, the sealing element 4, in particular in the region of the sealing lip 4.1, is deformed in such a manner that the sealing lip 4.1 lifts from the opening edge 1.2 of the container 1, with the result that the internal pressure Pi can escape at this point. A specific release of the excess pressure Pi is thereby possible.

Figure 4:
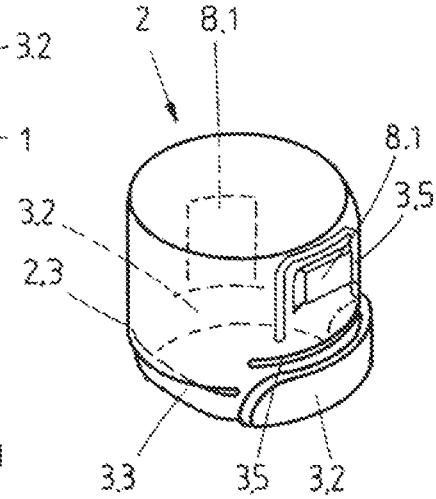
FIG. 4 shows a three-dimensional view of the closure device according to the invention from FIGS. 1 to 3.

In order to enable easy, one-handed operation of the actuating element 3.2 and/or the actuating means 8.1, this can be let in by means of incisions 3.5 or grooves 3.5 in the closure element 3. These incisions 3.5 only partially border the actuating element 3.2 or the actuating means 8.1 so that these elements or means are still firmly connected to the closure element 3 by means of a connecting web. The closure device 2 with the closure element 3 and the actuating means 8.1 expediently forms a one-part element. In FIG. 4 it can be clearly seen on the actuating means 8.1 how this is surrounded by an inverted U-shaped incision 3.5. Further provided above the actuating element 3.2 is a horizontal incision 3.5 which also separates the actuating element 3.2 from the actuating means 8.1.

In the region to the right of the longitudinal axis 2.1, FIG. 1 shows how the sealing lip 4.1 rests on the opening edge 1.2. In the region to the left of the longitudinal axis 2.1 in FIG. 1 on the other hand, the sealing lip 4.1 is easily lifted or pressed in by the actuating means 8.1. Naturally, a pressure Pt on the actuating means 8.1 is required for this.

The special sealing element 4 ensures that the sealing lip 4.1 is pressed more firmly and/or more extensively on the opening edge 1.2, the higher the internal pressure Pi in the container 1. This internal pressure can be increased, for example, by a carbonic-acid containing fluid 9 or drink 9.

Figure 2:
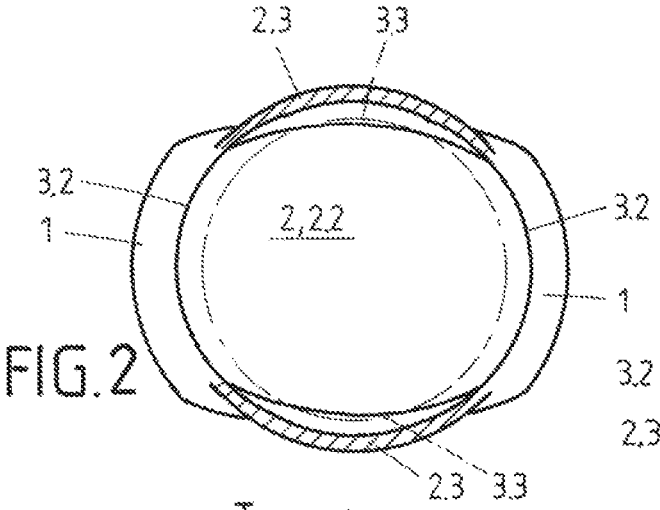
FIG. 2 shows a cross-section II-II through a closure device according to the invention from FIG. 1.

By means of a cross-section, FIG. 2 shows how the strip-shaped holding means 3.3 abuts behind the annular projection 1.6 when the closure device 2 is in the first position 1. The oval profile of the strip-shaped holding means 3.3 on the outer wall of the container 1 can also be identified here.

Figure 3:
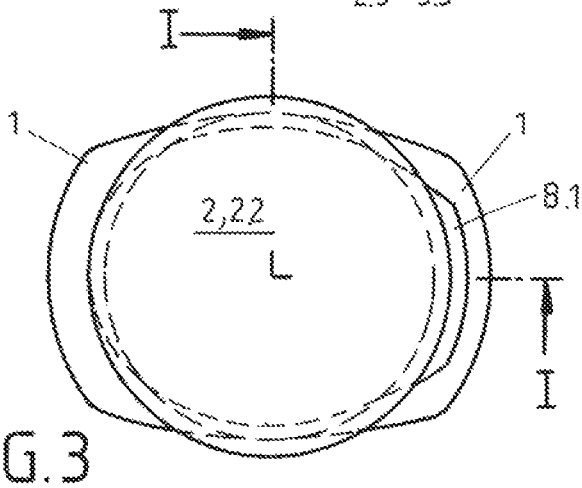
FIG. 3 shows a plan view of the first exemplary embodiment of a closure device according to the invention.

FIG. 3 shows a plan view of the closed container 1, wherein in this view only one actuating means 8.1 is provided on the right-hand side of the closure device 2. This can naturally also additionally be provided on the left-hand side, i.e. turned through 180°, on the closure device 2, as shown in FIG. 4.

Figure 5:
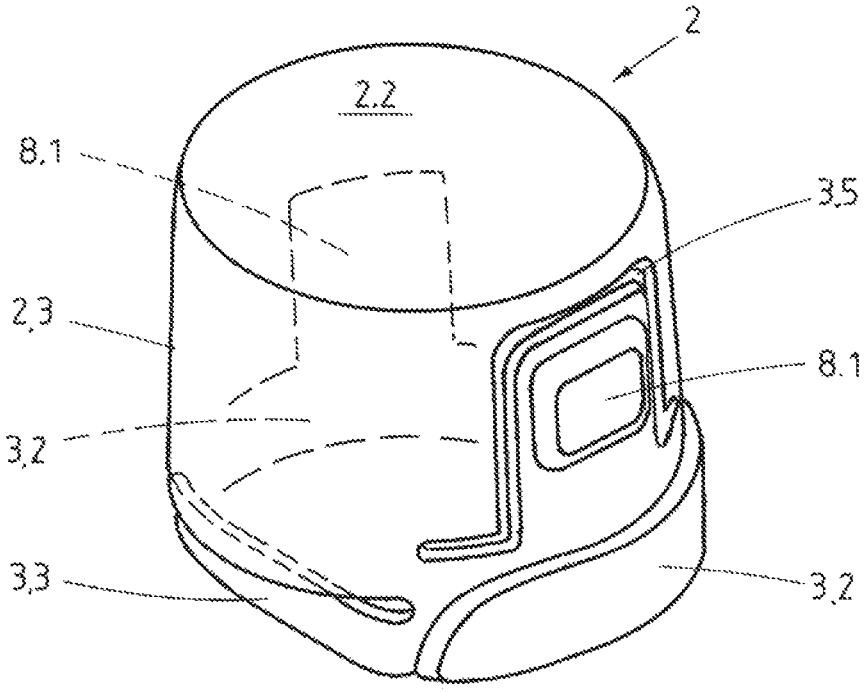
FIG. 5 shows a three-dimensional view of a further exemplary embodiment of a closure device according to the invention, in which the actuating means is connected to the actuating element.

FIG. 5 shows a further exemplary embodiment of a closure device 2 which differs from the exemplary embodiment from FIGS. 1 to 4 in that the actuating element 3.2 is mechanically connected to the actuating means 8.1. In this exemplary embodiment, the horizontal incision 3.5 between the actuating element 3.2 and the actuating means 8.1 from FIG. 4 is absent. Consequently, a pressure Pt on the actuating element 3.2 simultaneously results in an actuation of the actuating means 8.1 or also conversely. In order to increase the flexibility of the actuating element 3.2, the inverted U-shaped incision 3.5 about the actuating means 8.1 continues horizontally at the lower ends. In this exemplary embodiment, the same sealing elements 4 from FIGS. 1 to 4 can be used.

FIG. 6 shows a further closure device with a click-clack closure 10 as closure element 3 in longitudinal section. In this case, the sealing element 4 does not project from the lower opening of the closure element 3 so that it can be safely said that the sealing element 4 is disposed or integrated completely in the closure element 3 or the closure device 2. This integration now has the advantage that the sealing element 4 does not touch a table or other placement surface when the closure device 2 is removed from the container 1 and placed on the placement surface, regardless of on which side. Consequently, an unintentional wear of the sealing element 4, in particular of the sealing lip 4.1, can be reliably avoided. In addition, the integrated sealing element 4 can ensure that the sealing lip 4.1 is not crimped or crumpled when the closure device 2 is placed on the opening edge 1.2 of the container. On the contrary, the external holding means 3.3 now provides for a first positioning of the closure device 2 on the opening edge 1.2. A secure handling is thus ensured by the integrated sealing element 4.

Furthermore, FIG. 6 shows a tamper-evident closure 11 which comprises a paper seal or a film seal. The opening of the passage 6.2 in the securing element 6 is completely closed by this tamper-evident closure 11. If the container is merely to be opened by the closure device 2, the tamper-evident closure 11 must be destroyed or removed so that a pressure Pk can be applied through the passage 6.2 onto the closure element 3, in particular the centre piece 3.1. A pull tab 11.1 can additionally be provided so that the tamper-evident closure 11 can easily be removed. It is also feasible to provide the tamper-evident closure 11 with predetermined breaking points 11.2 in order to be able to determine an immediate destruction on opening.

In FIG. 6 holding elements 3.3 of the closure element 3 are bent outwards and thus configured as closing means 3.4 of which one is visible and one is indicated in FIG. 6. Preferably at least three holding means 3.3 are configured as closing means 3.4 which can occupy an angle of 120° between each other. The securing element 6 abuts with its edge zone 6.1 from outside against the closing means 3.4, the closing means 3.4 being configured as a rounding of the edge zone 6.1. If a user exerts a perpendicular pressure (parallel to the arrow Pk) on the upper region of the securing element 6, the edge zone 6.1 only acts on the closing means 3.4, whereby the closure element 3 is sealed (position I of the closure device 2). At the same time, the closing means 3.4 can be used to connect the closure element 3 to the securing element 6 securely and positively. Consequently, the lower flanged edge of the edge zone 6.1 could also end at the height of the closing means 3.4 or at least cooperate mechanically with this. In the case of FIG. 6, the lower flanged edge of the edge zone 6.1 serves as a terminating or placement surface or edge of the closure device 2. The opening of the closure device 2 is accomplished exclusively by a pressure Pk through the passage 6.2 onto the central region of the closure element 3 which is disposed about the longitudinal axis 2.1 below the passage 6.2. By this means the holding means 3.3 jump radially outwards and release a form fit with the container 1. Consequently, one-handed operation is easily possible both during opening and during closing.

Figure 7A:
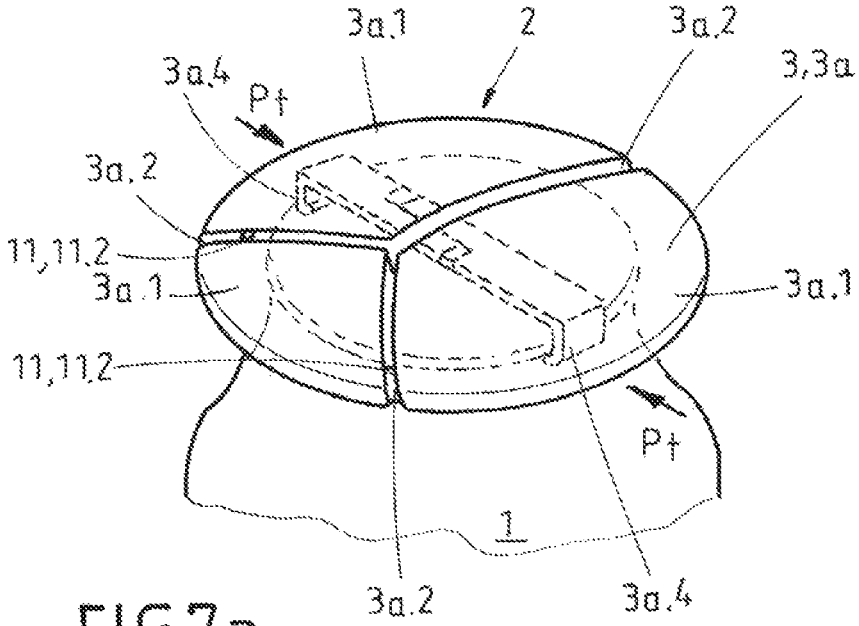
FIG. 7*a* shows a three-dimensional view of a further closure device according to the invention with a "three-part" closure element.
Figure 7B:
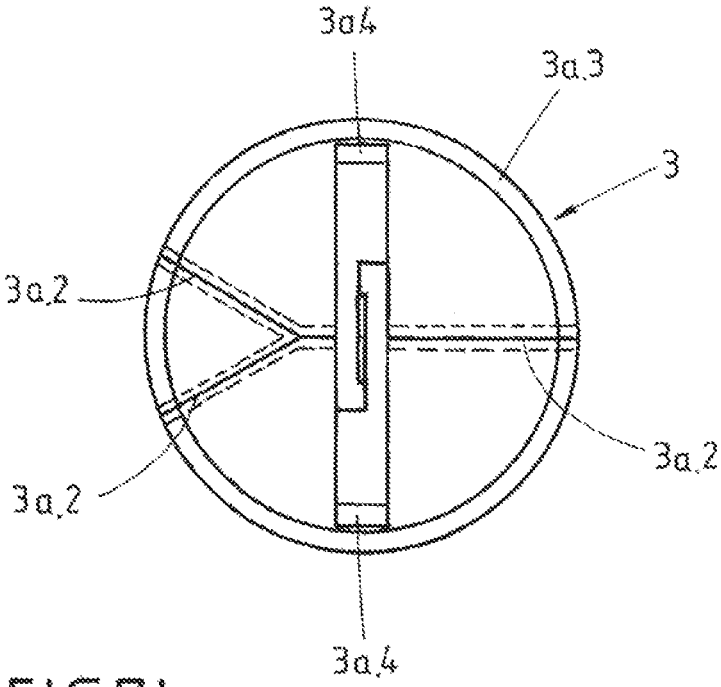
FIG. 7*b* shows a rear view of the closure element from FIG. 7*a*.

FIGS. 7*a* and 7*b* show a further variant of the closure device 2 according to the invention, wherein here a special closure element 3, 3*a* is provided. In this variant, the closure device 2 can overall have a two-part structure, wherein the closure element 3 forms the first part and the sealing element 4 optionally with a retaining plate 5 forms the second part. It is also feasible to produce the closure device 2 from FIGS. 7*a* and 7*b* in one part, in which case the retaining plate 5 must be connected to the closure element 3. This can be accomplished, for example, by means of an additional fastening means such as, for example, screws, rivets or the like or, however, the retaining plate 5 is, for example, welded, adhesively bonded or injection-moulded to the closure element 3. In principle, the closure element 3 from FIGS. 7*a* and 7*b* functions as described hereinafter.

The closure element 3, 3*a* is substantially constructed as plate-shaped, comprising three individual, in particular circular-segment-like pieces 3*a*.1 which are interconnected by means of film hinges 3*a*.2. The three pieces 3*a*.1 substantially divide the closure element 3*a* into a "star shape". In order to prevent slipping of the closure element 3*a* from the opening 1.1, the closure element 3*a* has an angled outer edge zone which is configured to be somewhat larger than the contour of the opening edge 1.2. In the first position of the closure element 3*a*, the opening edge 1.2 projects in this angled edge zone 3*a*.3 so that the closure element 3*a* can be displaced to and fro on the opening 1.1 with slight play. The closure element 3 is held positively on the opening edge 1.2 by the two diametrically arranged fastening hooks 3*a*.4 which serve as holding means 3.3. In this case, (see FIG. 7*b*) the upper fastening hook 3*a*.4 is disposed on the lower star piece 3*a*.1 of the closure element 3*a* and the lower fastening hook 3*a*.4 is disposed on the upper star piece 3*a*.1 of the closure element 3*a*. If the upper star piece 3*a*.1 is now pressed onto the lower one, the distance between the two fastening hooks 3*a*.4 increases so that the opening edge 1.2 of the container 1 is released since the fastening hooks 3*a*.4 no longer grip the projection 1.6 of the container 1 in this intermediate position. As a result, the closure device 2 according to the invention can easily be lifted from the opening 1.1, with one-handed operation also being possible in this case. The closure device 2 according to the invention from FIGS. 7*a* and 7*b* can be fastened by pressing together the two extensive star pieces fastening hooks 3*a*.1 of the closure element 3 (see arrows) so that the distance between the two fastening hooks 3*a*.4 is increased and the closure device 2 can be guided over the opening edge 1.2, in particular the projection 1.6. The closure element 3 can then be released, wherein the film hinges 3*a*.2 provided between the individual star pieces 3*a*.1 press these apart, with the result that the distance between the fastening hooks 3*a*.4 is again reduced so that these grip behind the projection 1.6. By this means the closure element 3*a* overall is fastened positively on the container 1. Since the sealing element 4 with the sealing lip 4.1 is further used, the already-mentioned sealing of the container 1 takes place.

In addition, two or more predetermined breaking points 11.2 can be provided as a tamper-evident closure 11 in the area of the film hinges 3*a*.2 between the two large star pieces 3*a*.1 and the respective small star piece 3*a*.1, which break when the closure device 2 is actuated for the first time. As a result of a pressure on the two large star pieces 3*a*.1, the small star piece 3*a*.1 is pressed out from the existing angle, in which case it can result in the desired breaking of the predetermined breaking points.

Figure 8:
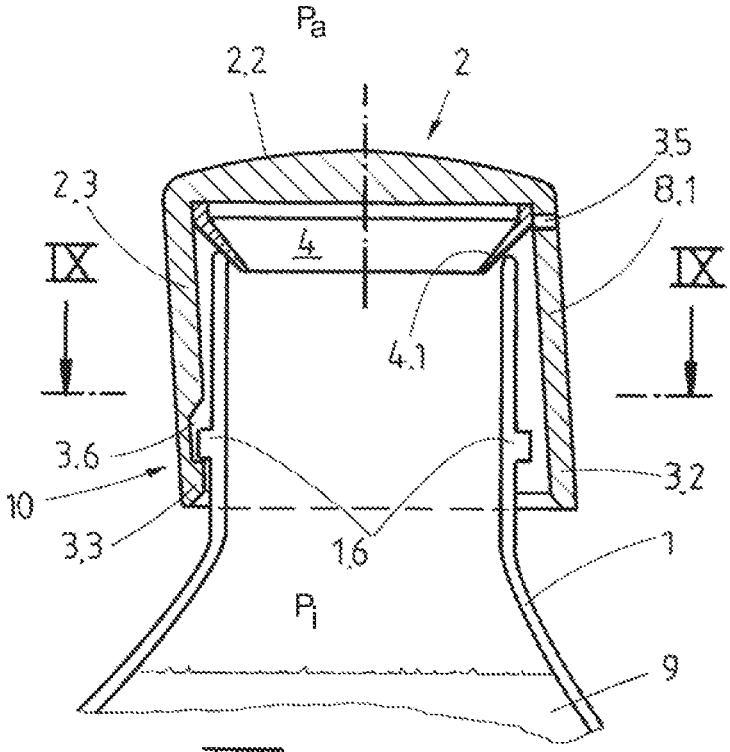
FIG. 8 shows an angled section VIII-VIII through a further exemplary embodiment of the closure device according to the invention from FIG. 9.
Figure 9:
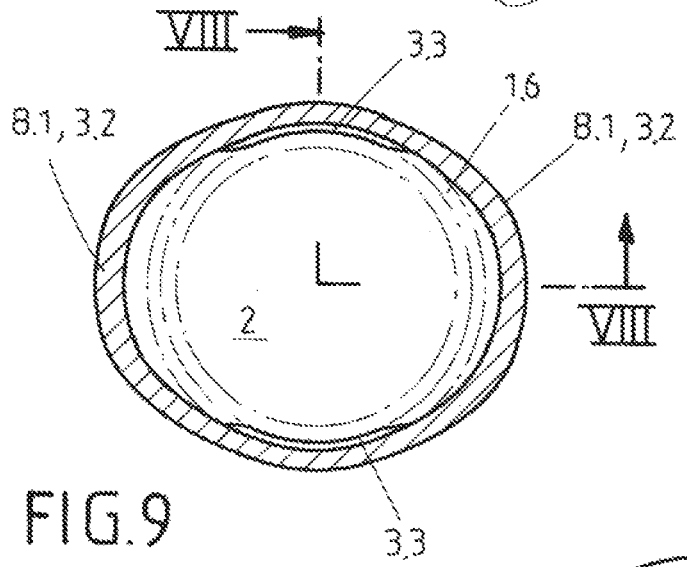
FIG. 9 shows a cross-section IX-IX through the closure device from FIG. 8.
Figure 10:
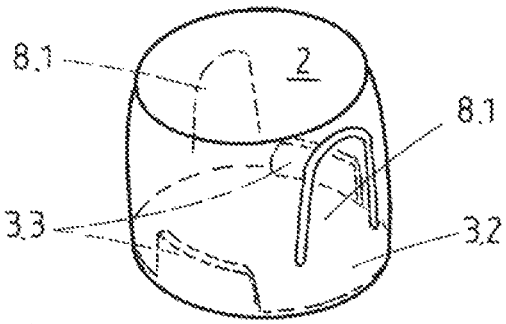
FIG. 10 shows a three-dimensional view of the closure device from FIGS. 8 and 9.

FIGS. 8, 9 and 10 show a further exemplary embodiment of the closure device 2 according to the invention. This is similar to the exemplary embodiments from FIGS. 1 to 5, where the holding means 3.3 are not configured to be strip-shaped but barb-shaped. In this closure element 3, the deformability of the lower part 2.3 of the closure device 2 forming the closure element 3 itself is used. As can be seen from FIG. 9, the lower part 2.3 is not circular but oval or elliptical and has two arcuate, barb-shaped holding means 3.3, which cooperate positively with the annular projection 1.6 of the container 1. In this case, also a pressure Pt is applied to the actuating element 3.2, whereby the arcuate holding means 3.3 expand radially and release the form fit to the projection 1.6. As soon as the pressure Pt on the actuating element 3.2 relaxes, the closure element 3 re-acquires its oval or elliptical shape, the holding means 3.3 being brought together again radially. The advantage of the present closure device 2 from FIGS. 8 to 10 is that this only needs to be pressed from above, that is by a pressure in the direction of the longitudinal axis 2.1 on the opening edge 1.2 of the container 1, whereby the barb-shaped holding means 3.3 with their tips or slopes on the annular projection 1.6 automatically expand and automatically hook behind the projection 1.6 when the pressing-in depth is sufficient. Consequently, the holding means 3.3 are configured to be automatically springy and have a slope. A recess 3.6 can be provided so that the projection 1.6 can be accommodated in the lower part 2.3. Naturally, any other form fit between the holding means 3.3 and the counter-holding means 1.6 is feasible.

In FIG. 9 it is clear that the holding means 3.3 are configured to be arcuate and cooperate positively over a wide region with the annular projection 1.6 of the container 1. The closure device 2 is shown in the closed position I in FIGS. 8 and 9.

FIG. 10 shows a three-dimensional view of the closure device 2, where the holding means 3.3 already described are indicated on the inner wall of the closure element 3.

Figure 11:
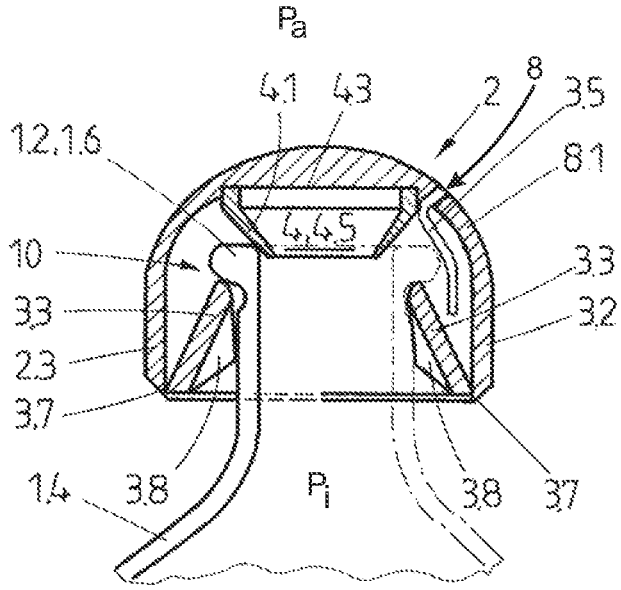
FIG. 11 shows a longitudinal section XI-XI through an additional exemplary embodiment of the closure device according to the invention from FIG. 12.
Figure 12:
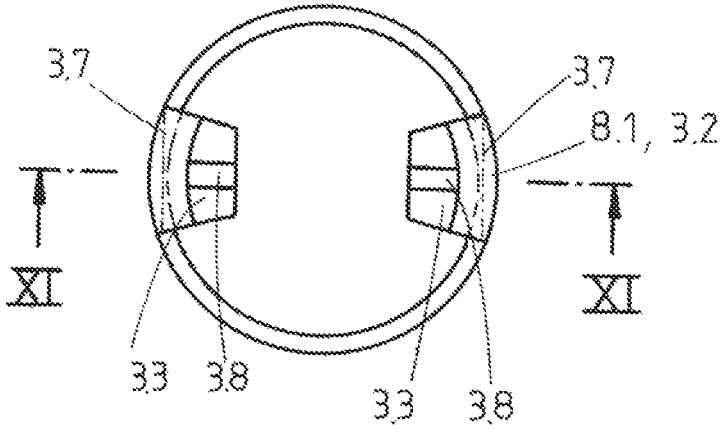
FIG. 12 shows a rear view of the closure device from FIG. 11
Figure 13:
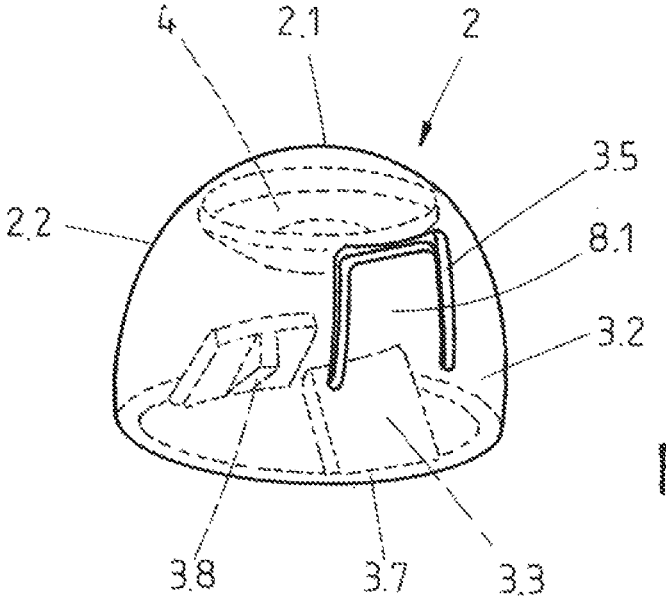
FIG. 13 shows a three-dimensional view of the sealing element of the closure device from FIGS. 11 and 12.

FIGS. 11, 12 and 13 show an additional exemplary embodiment of the closure device 2, where a rocker-like holding means 3.3 is used for arresting the closure device 2 on the container 1. To illustrate the mode of operation, the right bottle neck is merely indicated. This exemplary embodiment from FIGS. 11 to 13 is similar to the exemplary embodiments from FIGS. 1 to 5 and FIGS. 8 to 10. In this case, the closure device 2 is configured to be substantially circular or spherical since on this occasion a radial expansion of the holding means 3.3 is not used to produce a form fit with the container 1. On the contrary a pressure on the actuating element 3.2 is used to pivot away the holding means 3.3, a rocker 3.8 on the holding means 3.3 being used for this purpose. The two holding means 3.3 provided are seamlessly connected to the two actuating elements 3.2 by means of film hinges 3.7. A pressure Pt on the actuating elements 3.2, which in the same way as the holding means 3.3, are disposed offset by 180° on the closure element 3, is used to tilt the holding means 3.3 away. At the same time, the triangular rocker 3.8 on the holding means 3.3 serves the purpose of tilting this away at the free corner of the rocker 3.8 which comes to rest on the bottle neck 1.1 from outside. Consequently, the upper ends of the holding means 3.3 pivot behind the projection (by moving away from one another radially) to release the form fit in the container 1. In this exemplary embodiment a valve 8 is also provided for the sealing element 4 which can again be operated by means of an actuating means 8.1. The actuating means 8.1 is connected mechanically to the actuating elements 3.2. Expediently the closure device 2, the closure element 3 and the actuating means 8.1 are made of plastic, in particular as an injection moulding. The sealing element 4 is usually made of a different material, as has already been mentioned.

It can be clearly identified in FIG. 12 that the rockers 3.8 on the actuating elements 3.2 are only configured to be beam-like and do not run over the entire width of the holding means 3.3. In FIG. 13 the holding means 3.3 with the corresponding rockers 3.8 are shown in a three-dimensional view. In this case, the holding means 3.3 project in a ramp-like manner into the interior of the closure device 2 and are supported by their rockers 3.8 on the outer wall 1.4 of the container 1.

The invention claimed is:

1. A closure device for closing and/or opening an opening of a container, wherein the opening of the container is closed in a first position of the closure device and the opening of the container is open in a second position of the closure device, and wherein the opening of the container has an opening edge, which comprises an inner wall and an outer wall, wherein the closure device has a sealing element whereby the opening of the container can be closed in a sealed manner in the first position, wherein the closure device in the first position is fastened on the container by a closure element and on opening the container, can be transferred from the first position into the second position by means of at least one actuating element, wherein the container opening can be opened merely by a pressure being applied to the actuating element, wherein the closure device is fitted with a valve, wherein the valve is configured as a pressure relief valve or a drain valve and has an actuating means for actuating and, wherein the actuating element of the closure element and the actuating means of the valve can be actuated simultaneously, wherein the actuating element is mechanically connected to the actuating means.

2. The closure device according to claim 1, wherein the sealing element has a sealing lip which projects at least partially into the opening of the container and comes to abut sealingly against the inner wall of the opening edge due to an elastic deformation.

3. The closure device according to claim 1, wherein a sealing effect is achieved due to a shape, a size and a material properties of the sealing element.

4. The closure device according to claim 1, wherein contact pressure that is applied from the closure device onto the container is substantially without effect on the sealing element.

5. The closure device according to claim 1, wherein the container can be sealed by the closure device by means of the sealing element in a pressure-tight and/or fluid-tight manner, wherein the closure device can be reused.

6. The closure device according to claim 2, wherein the sealing lip of the sealing element is only pressed onto the inner wall by its elastic deformation, wherein an internal pressure of the container additionally presses the sealing lip onto the inner wall if the internal pressure is greater than an external pressure surrounding the container from outside.

7. The closure device according to claim 1, wherein the closure element cooperates positively with the container by means of at least one holding means by means of a closure comprising a bayonet closure, a click-clack closure, a clasp closure, a clip closure, a loop closure and/or a sliding closure.

8. The closure device according to claim 1, wherein the actuating element and/or the actuating means are configured to be button-like, wherein an actuation or movement is made easier by partially slit-shaped incisions which adjoin the actuating element and/or the actuating means.

9. The closure device according to claim 1, wherein the closure element has at least one holding means which cooperates positively with the container and with a projection or a recess on the container in order to fasten the closure device in the first position, wherein the pressure on the actuating element releases a form fit.

10. The closure device according to claim 9, wherein the pressure on the actuating element effects a deformation and/or a movement of the holding means.

11. A container for fluids, having a closure device according to claim 1.

12. A method for closing and opening an opening of a container by a closure device, wherein the opening of the container is closed in a first position of the closure device, a sealing element closes the opening of the container in a sealing manner and a closure element fastens the closure device on the container in a form-fitting connection in the first position, wherein the closure element has an actuating element for opening the container, wherein at least a pressure must be applied to the actuating element for opening the container, wherein the closure device is fitted with a valve, wherein the valve is configured as a pressure relief valve or a drain valve and has an actuating means for actuating, and wherein the actuating element of the closure element and the actuating means of the valve can be actuated simultaneously, wherein the actuating element is mechanically connected to the actuating means.

13. The method for closing and opening a container according to claim 12, wherein the closure device is used to execute the method, wherein the opening of the container is closed in the first position of the closure device and the opening of the container is open in a second position of the closure device, wherein the opening of the container has an opening edge, which comprises an inner wall and an outer wall, wherein the closure device has a sealing element whereby the opening of the container can be closed in a sealed manner in the first position, wherein the closure device in the first position is fastened on the container by a closure element and on opening the container, can be transferred from the first position into the second position by means of at least one actuating element, and wherein the container opening can be opened by a pressure being applied to the actuating element.

* * * * *